US012330900B2

(12) United States Patent
Lim

(10) Patent No.: US 12,330,900 B2
(45) **Date of Patent: *Jun. 17, 2025**

(54) ADJUSTABLE COIL ADAPTER MECHANISM

(71) Applicant: Reel Power Licensing Corp., Oklahoma City, OK (US)

(72) Inventor: Brent S Lim, Oklahoma City, OK (US)

(73) Assignee: Reel Power Licensing Corp., Oklahoma City, OK (US)

( * ) Notice: Subject to any disclaimer, the term of this patent is extended or adjusted under 35 U.S.C. 154(b) by 205 days.

This patent is subject to a terminal disclaimer.

(21) Appl. No.: 18/111,022

(22) Filed: Feb. 17, 2023

(65) Prior Publication Data

US 2023/0202794 A1 Jun. 29, 2023

Related U.S. Application Data

(63) Continuation of application No. 17/509,240, filed on Oct. 25, 2021, now Pat. No. 11,608,244, which is a continuation of application No. 16/934,491, filed on Jul. 21, 2020, now Pat. No. 11,180,340.

(60) Provisional application No. 62/877,665, filed on Jul. 23, 2019.

(51) Int. Cl.
*B65H 49/36* (2006.01)
*B65H 75/24* (2006.01)

(52) U.S. Cl.
CPC ..... *B65H 49/36* (2013.01); *B65H 75/242* (2013.01)

(58) Field of Classification Search
CPC .. B65H 49/36; B65H 75/2484; B65H 75/248; B65H 75/242; B65H 49/30
See application file for complete search history.

(56) References Cited

U.S. PATENT DOCUMENTS

| | | | | |
|---|---|---|---|---|
| 2,300,869 | A | 11/1942 | Brandes, Jr. | |
| 2,370,868 | A | 3/1945 | Luebke | |
| 3,840,195 | A | 10/1974 | Zebny | |
| 5,025,999 | A | 6/1991 | Littrell | |
| 11,180,340 | B2 * | 11/2021 | Lim | B65H 49/36 |
| 11,608,244 | B2 * | 3/2023 | Lim | B65H 75/242 |
| 2005/0253015 | A1 | 11/2005 | Bohnisch | |
| 2009/0026304 | A1 | 1/2009 | Yu et al. | |

FOREIGN PATENT DOCUMENTS

| | | | |
|---|---|---|---|
| CH | 618661 | A5 | 8/1980 |
| DE | 102010005720 | B3 | 7/2011 |
| JP | 2013155004 | A | 8/2013 |
| JP | 2014168828 | A | 9/2014 |

* cited by examiner

*Primary Examiner* — William A. Rivera
(74) *Attorney, Agent, or Firm* — Phillips Murrah PC; Martin G. Ozinga

(57) ABSTRACT

An apparatus, system, and method for providing pay-out head utilized in unwrapping elongated materials with adjustable pintle flanges that allows for keeping a coil pack stay concentric on the head during the unwrapping.

1 Claim, 6 Drawing Sheets

ADJUSTABLE COIL ADAPTER MECHANISM

CROSS-REFERENCE TO RELATED APPLICATIONS

The present invention is a continuation of U.S. patent application Ser. No. 17/509,240, filed on Oct. 25, 2021, which is a continuation of U.S. patent application Ser. No. 16/934,491, filed on Jul. 21, 2020, now U.S. Pat. No. 11,180,340, issued on Nov. 23, 2021, which claims priority from U.S. Provisional Application Ser. No. 62/877,665 filed on Jul. 23, 2019. Each of the applications listed above is expressly incorporated herein by reference in their entirety.

BACKGROUND OF INVENTION

1. Field of the Invention

In general, the present invention relates to an apparatus and or system used to coil and or uncoil lengths of elongate materials such as but not limited to hoses, cable, tubing, wiring and the like. More particularly, the present invention provides an improved adjustable coil adapter mechanism for but not limited to cardboard core coil packs.

2. Description of the Prior Art

In general, lengths of material that are usually relatively long and flexible are wound on large reels and or spools by a manufacturer. It is known for redistribution to take these large reels and or spools of materials into smaller amounts for redistribution. The machines associated with such are often referred to as automatic cut and transfer coiling and or spooling machines. Spooling is typically a reference to taking the elongated material from a large spool and or reel to a smaller desired length for redistribution then wrapped around another spool and or reel for redistribution. Coiling is typically a reference to taking the elongated material from a large spool and or reel to a smaller desired length for redistribution and wrapping it freely into a coil with no spool and or reel.

It is known that some elongated material may come from and or be wound on a spool with a cardboard core that is installed in a piece of equipment, such as but not limited to a pay-off machine, for unwinding and transferring onto another machine such as automatic cut and transfer coiling and or spooling machines. The inner diameters or ID's of the cardboard cores can vary slightly and need to be gripped firmly while the material is being transferred at a high rate of speed to another machine. Prior art methods for gripping the coil core include manually expanding an adapter inside the core and then installing lock bolts to squeeze the flanges axially against the core. These are labor intensive and can impact overall process time.

Thus, there is a need for a new and improved adjustable coil adapter mechanism for cardboard core coil packs. It is desirable to fill these needs with a reliable alternative that is affordable and functional. The above discussed limitations in the prior art is not exhaustive. The current invention provides an inexpensive, time saving, more reliable apparatus, method and system where the prior art fails.

SUMMARY OF THE INVENTION

In view of the foregoing disadvantages inherent in the known types of uncoiling and or coiling now present in the prior art, the present invention provides a new and improved apparatus, system, and method of using the same. As such, the general purpose of the present invention, which will be described subsequently in greater detail, is to provide a new and improved uncoiling and or coiling head for use with elongated materials, which has all the advantages of the prior art devices and none and or fewer of the disadvantages.

It is, therefore, contemplated that the present invention is an apparatus, system, and method for a new and improved adjustable coil adapter mechanism for cardboard core coil packs that may include an adjustable, pintle style adapter with finite adjustment to a given range of core sizes. Adjustable, tapered finger plates ride on a sloped groove that positions them along the diameter of the cardboard core. These finger plates securely grip the ID of the core with only the axial motion of the activating cylinder. A sloped groove may provide macro adjustment to account for large differences in core ID's.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in this application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting. As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

Therefore, it is an object of the present invention to provide a new and improved adjustable coil adapter for cardboard core coil packs apparatus, system, and method for use with elongated materials where it is desirable to prevent and or reduce time associated to adjust for variable inner diameters of the cardboard core.

Furthermore, an object of the present invention is to provide a new and improved adjustable coil adapter apparatus, system, and method, which allows for adjustable, pintle style flange adapter that allows direct installation of the wire coil pack with cardboard core, engaging both the ID and axial ends of the core by the activating cylinder motion, reducing human interaction and both labor and process time.

Another object of the present invention is to provide a new and improved adjustable coil adapter apparatus, system, and method, which may provide macro adjustment to account for large differences in cardboard core ID's.

Still another object of the present invention is to provide a new and improved adjustable coil adapter apparatus, system, and method, that may provide a fixed taper at the top of the finger plates, provides an interference fit, similar to the expanding core, and ensures adequate gripping force over at least half the length of the core.

Yet still another object of the present invention is to provide a new and improved adjustable coil adapter apparatus, system, and method, that may provide adjustable, tapered finger plates that may ride on a sloped groove that position them along the diameter of the cardboard core. These finger plates may securely grip the ID of the core with only the axial motion of the activating cylinder.

It is a further object of the present invention to provide a new and improved adjustable coil adapter apparatus, system, and method, which is of a durable and reliable construction and may be utilized in numerous types of coiling and or uncoiling applications.

An even further object of the present invention is to provide a new and improved adjustable coil adapter apparatus, system, and method, which is susceptible to a low cost of manufacture, which accordingly is then susceptible to low prices of sale to the consuming industry, thereby making such a system economically available to those in the industry.

Still another object of the present invention is to provide a new and improved adjustable coil adapter apparatus, system, and method, which provides all of the advantages of the prior art while simultaneously overcoming some of the disadvantages normally associated therewith.

These, together with other objects of the invention, along with the various features of novelty, which characterize the invention, are pointed out with particularity in the claims annexed to and forming a part of this disclosure. For a better understanding of the invention, its operating advantages, and the specific objects attained by its uses, reference should be had to the accompanying drawings and descriptive matter in which there are illustrated preferred embodiments of the invention.

BRIEF DESCRIPTION OF THE PICTORIAL ILLUSTRATIONS, GRAPHS, DRAWINGS, AND APPENDICES

The invention will be better understood and objects other than those set forth above will become apparent when consideration is given to the following detailed description thereof. Such description makes reference to the annexed pictorial illustrations, graphs, drawings, and appendices.

DETAILED DESCRIPTION OF INVENTION

Figure 1:
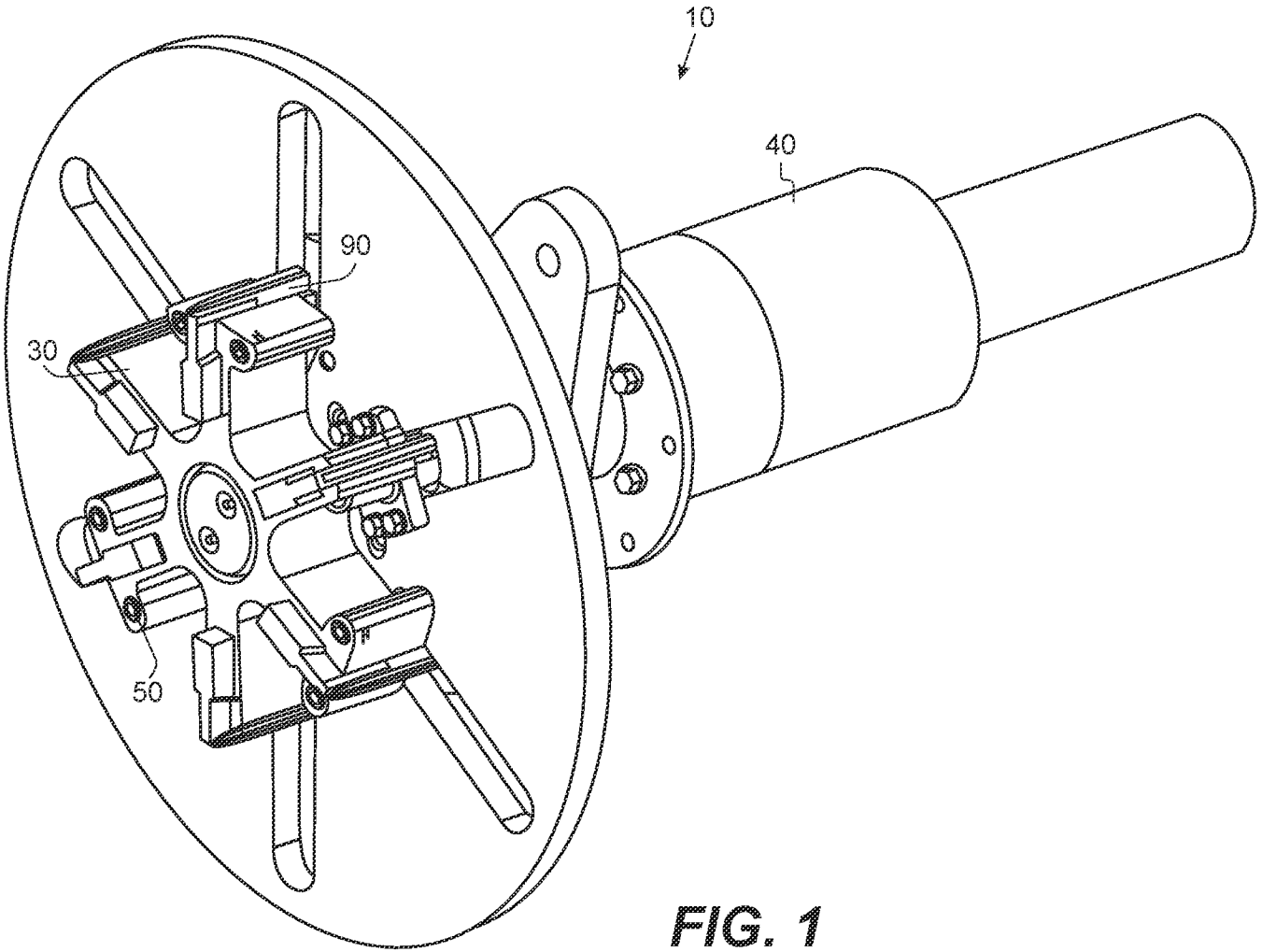
FIG. 1 is a general perspective illustration of a preferred embodiment of the invention depicting a head and part of a pay-off machine.
Figure 2:
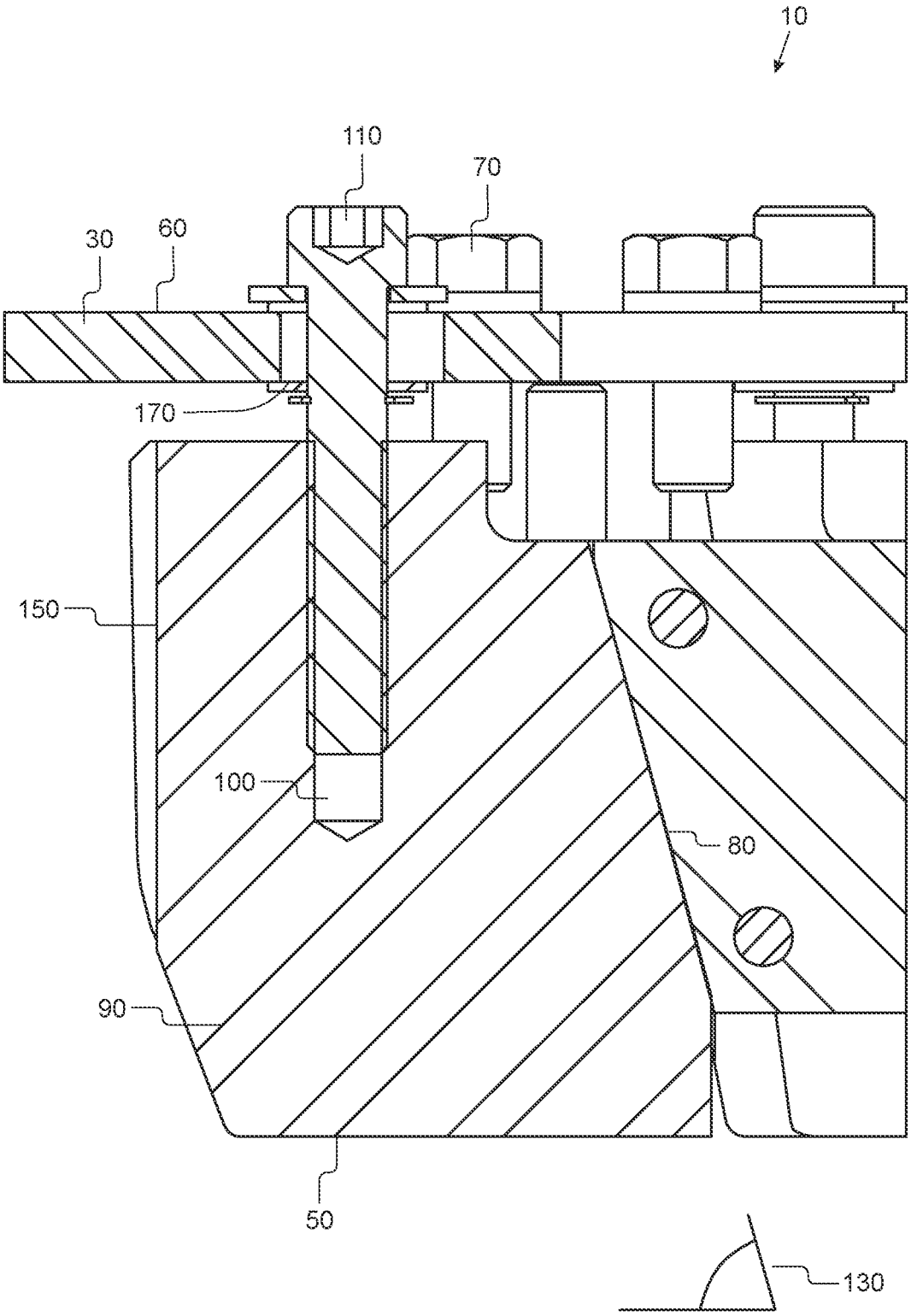
FIG. 2 is a general partial cutaway of a preferred embodiment of the invention.
Figure 3:
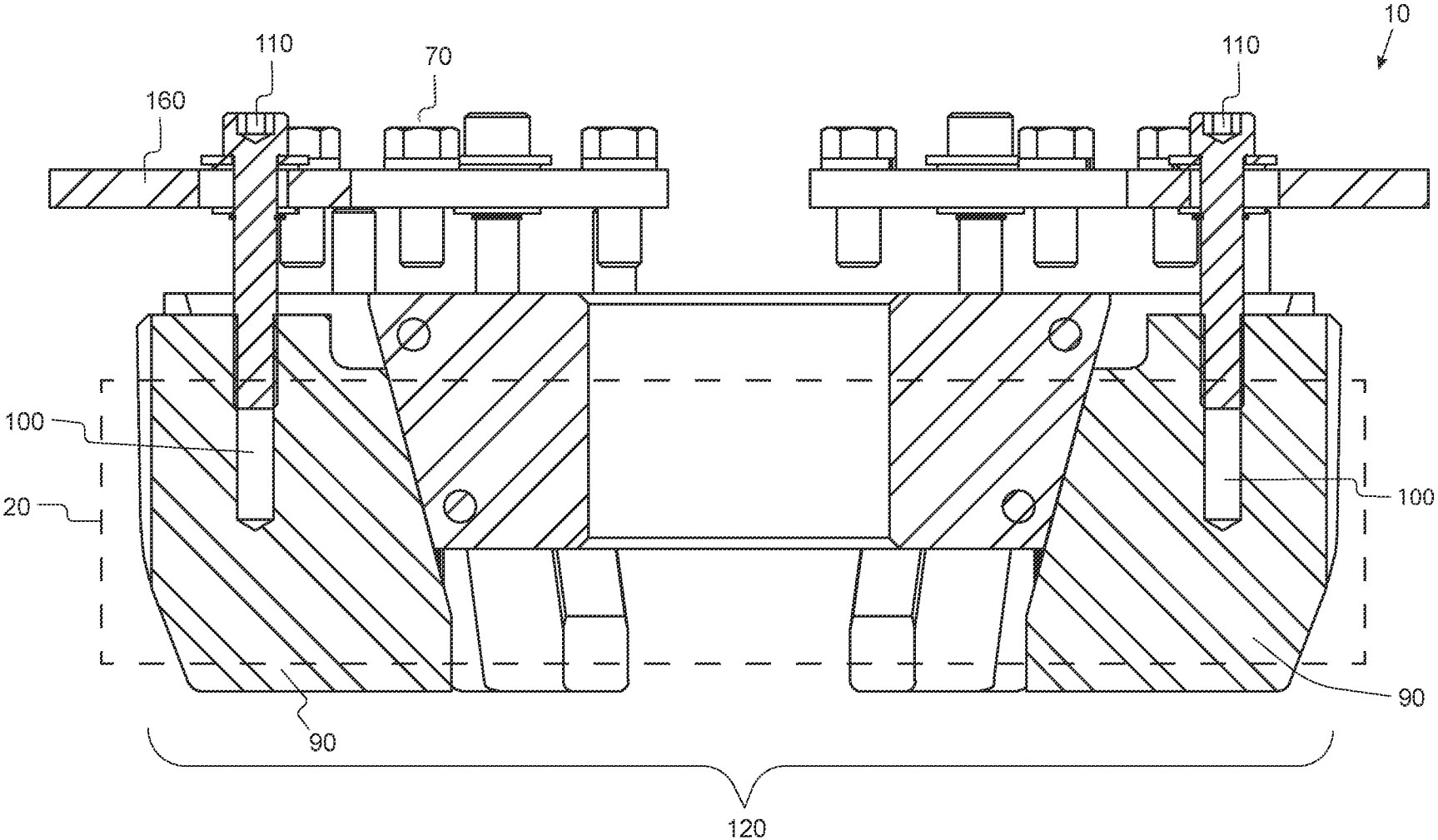
FIG. 3 is a general partial cutaway of a preferred embodiment of the invention.
Figure 4:
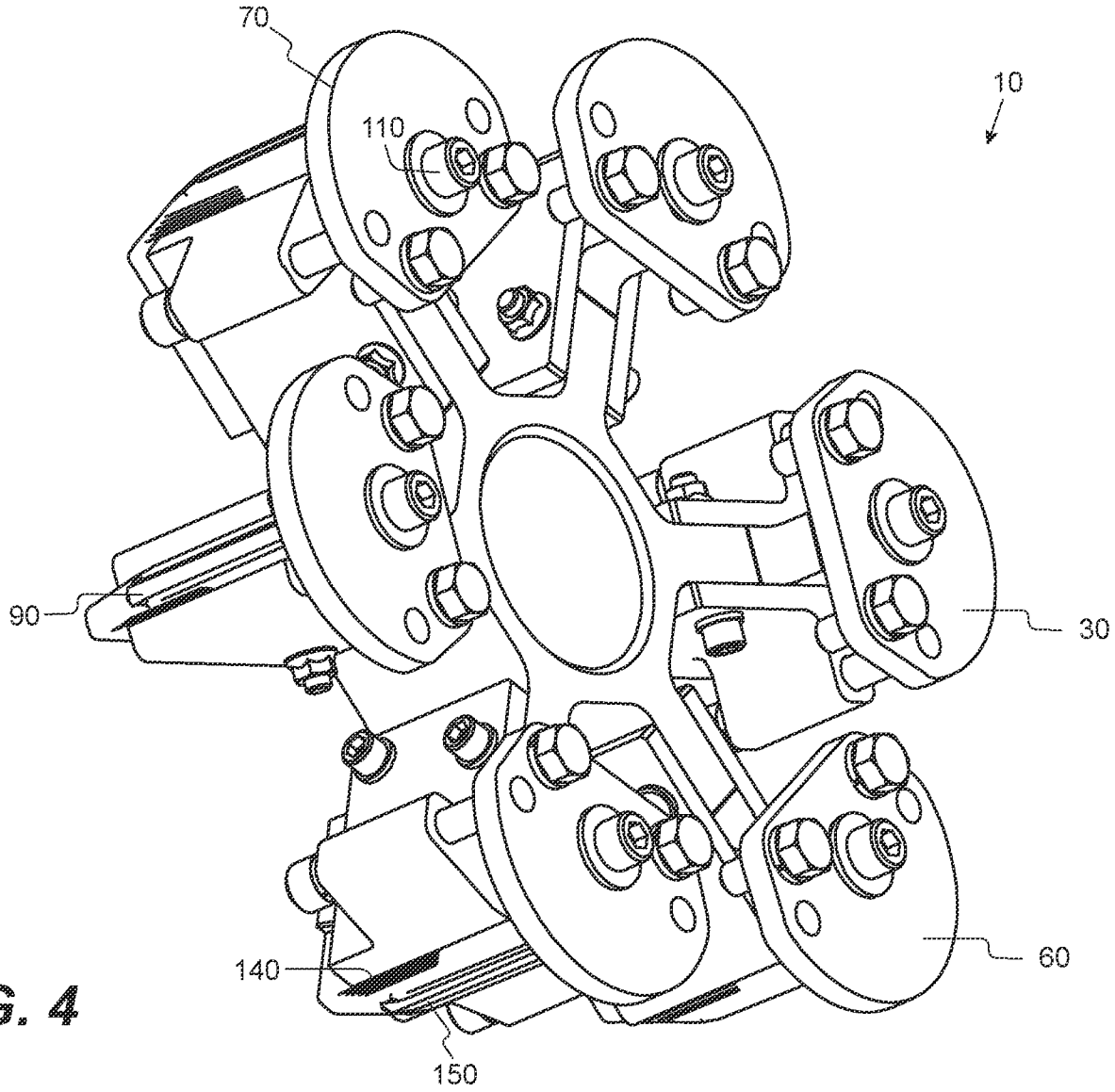
FIG. 4 is a general perspective illustration of a preferred embodiment of the invention depicting a back view of the head.
Figure 5:
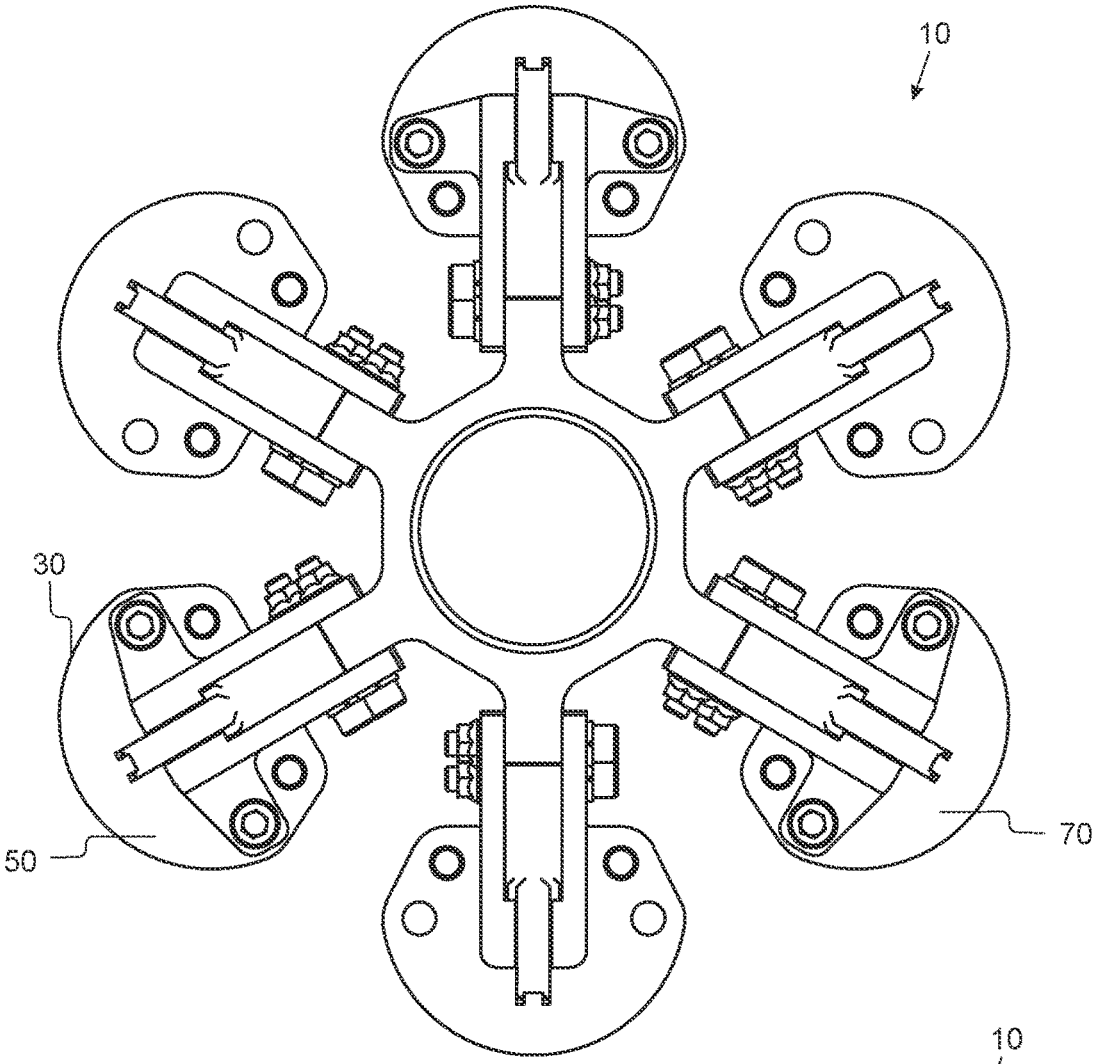
FIG. 5 is a general perspective illustration of a preferred embodiment of the invention depicting a front view of the head.
Figure 6:
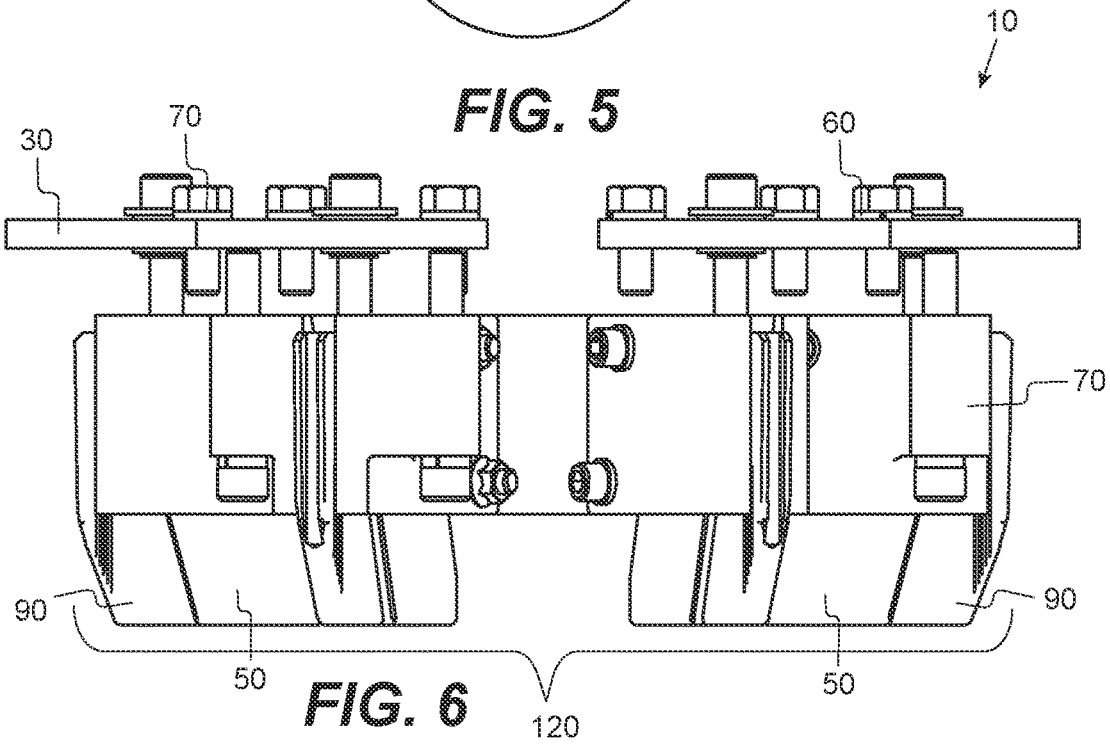
FIG. 6 is a general top view of a head of a preferred embodiment of the invention.
Figure 7:
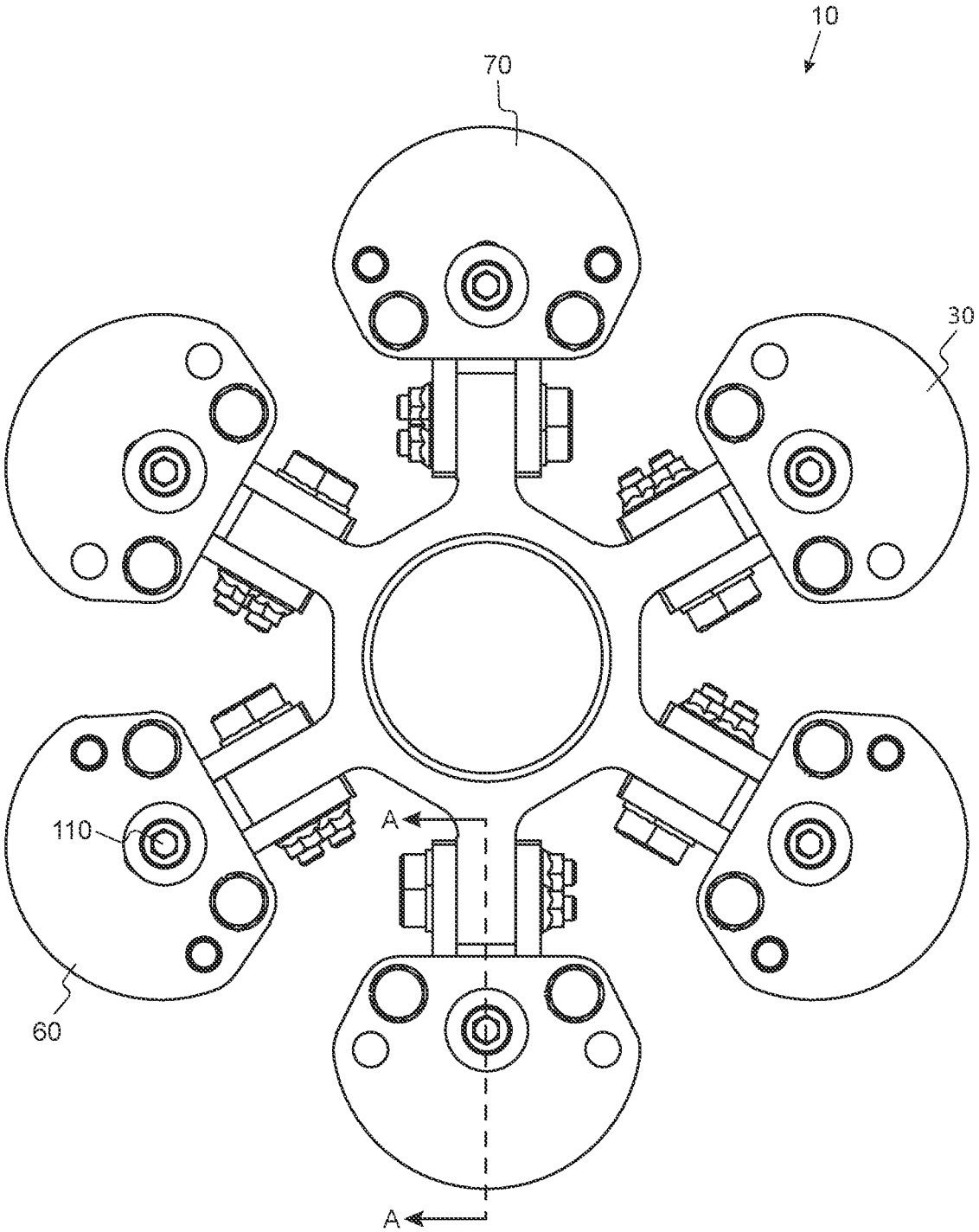
FIG. 7 is a general back view of a head of a preferred embodiment of the invention.

Referring to the illustrations, drawings, and pictures, and to FIG. 1 in particular, reference character 10 generally designates a new and improved adjustable coil adapter for cardboard core coil packs apparatus, system, and method of using the same constructed in accordance with the present invention. Invention 10 is generally used with elongated materials needing to be made into smaller segments for distribution from a larger spool and or reel utilized on a pay-off machine. Elongated materials may be but are not limited to electrical cables, steel cables, wire cables, hoses and so forth placed on a cylinder 20 that may be made from but not limited to cardboard It is understood that cylinder may be made from other relatively soft construction material. It is contemplated that invention 10 may be utilized with prior art devices. For purposes of convenience, the reference numeral 10 may generally be utilized for the indication of the invention, portion of the invention, preferred embodiments of the invention and so on. It is also to be understood that invention 10 should not be considered limited to just an uncoiling and coiling from cardboard core coil packs and the terms should not be considered to limit the invention to such.

Invention 10 may generally include head 30 that may be mounted to a pay-out machine 40. Head 30 may have a first side and or first end 50, a second side and or second end 60. Head 30 may have numerous pintle flanges 70, such as but not limited to six. It is understood that more or less are contemplated. Pintle flange 70 may have an angled and or sloped slot 80 for positioning finger wedges 90 with threaded receptor 100 for communication with threaded screw 110. Finger wedges 90 are threaded so they slide axially in and out with screw 110 and therefor the effective diameter 120 of the finger wedges 90 increases or decreases as each of the finger wedges 90 are adjusted together.

Sloped slot 80 generally corresponds with finger wedge 90 bottom angle 130. Finger wedge 90 may include scribe lines 140 to help keep all finger wedge(s) 90 at the same height to ensure the coil pack stays concentric on head 30. Finger wedge 90 top 150 may be slightly tapered to grip the inner diameter of the core. Screw 110 may be selectively captive against retaining plate 160 with a lock nut 170.

It is therefore contemplate that the current invention may be a pay-out machine for unwrapping elongated materials from a cardboard coil package comprising: a head having a first side and a second side wherein said second side is attached to said pay-out machine, at least four pintle flanges attached to said first side of said head wherein said at least four pintle flanges have sloped slots, at least four finger wedges positioned respectively in said sloped slots of said at least four pintle flanges and wherein said at least four finger wedges respectively have at least four threaded receptors and wherein said at least four finger wedges respectively have at least four corresponding slopes to match said sloped slots of said at least four pintle flanges, at least four threaded screws axially connecting said at least four threaded receptors of said at least four finger wedges to said at least four pintle flanges; and wherein at least four threaded screws respective rotation are adapted to keep said cardboard coil package concentric while unwrapping elongated materials from said pay-out machine.

Changes may be made in the combinations, operations, and arrangements of the various parts and elements described herein without departing from the spirit and scope of the invention. Furthermore, names, titles, headings, and general division of the aforementioned are provided for convenience and therefore, should not be considered limiting.

What is claimed is:

1. A pay-out machine for unwrapping elongated materials from a cardboard coil package comprising:

a head having a first side and a second side wherein said second side is attached to said pay-out machine, at least four pintle flanges attached to said first side of said head wherein said at least four pintle flanges have sloped slots, at least four finger wedges positioned respectively in said sloped slots of said at least four pintle flanges and wherein said at least four finger wedges respectively have at least four threaded receptors and wherein said at least four finger wedges respectively have at least four corresponding slopes to match said sloped slots of said at least four pintle flanges, at least four threaded screws axially connecting said at least four threaded receptors of said at least four finger wedges to said at least four pintle flanges; and wherein at least four threaded screws respective rotation are adapted to keep said cardboard coil package concentric while unwrapping elongated materials from said pay-out machine.

* * * * *